United States Patent [19]

Seilly

[11] 4,421,088

[45] Dec. 20, 1983

[54] FUEL SYSTEM FOR COMPRESSION IGNITION ENGINE

[75] Inventor: Alec H. Seilly, North Wembley, England

[73] Assignee: Lucas Industries Limited, Birmingham, England

[21] Appl. No.: 276,463

[22] Filed: Jun. 23, 1981

[30] Foreign Application Priority Data

Jul. 3, 1980 [GB] United Kingdom ..... 8021836

[51] Int. Cl.[3] ..... F02M 51/00

[52] U.S. Cl. ..... 123/447; 123/458

[58] Field of Search ..... 123/447, 458, 478, 494, 123/357

[56] References Cited

U.S. PATENT DOCUMENTS

| | | | |
|---|---|---|---|
| 3,699,931 | 10/1972 | Cinquegrani | 123/478 |
| 3,827,409 | 8/1974 | O'Neill | 123/447 |
| 3,844,263 | 10/1974 | Endo et al. | 123/458 |
| 3,949,713 | 4/1976 | Rivere | 123/458 |
| 3,949,714 | 4/1976 | Mitchell | 123/458 |
| 4,019,481 | 4/1977 | Lakra | 123/447 |
| 4,091,784 | 5/1978 | Seilly et al. | 123/447 |
| 4,275,693 | 6/1981 | Leckie | 123/447 |

FOREIGN PATENT DOCUMENTS

| | | | |
|---|---|---|---|
| 2539194 | 3/1977 | United Kingdom | 123/494 |
| 595533 | 2/1978 | U.S.S.R. | 123/447 |

*Primary Examiner*—Ira S. Lazarus
*Assistant Examiner*—Magdalen Moy

[57] ABSTRACT

A fuel system for a compression ignition engine comprises a plurality of injection nozzles controlled by electromagnetic devices to deliver fuel in timed relationship to an engine. Fuel for the nozzles is stored under pressure in accumulators which are charged from a source of fuel through small bore pipes so that the recharging of the accumulators after fuel delivery is delayed. Transducers are provided and are responsive to the pressure in the accumulators. The signals provided by the transducers register a pressure drop when fuel flows through the nozzles and the fall in pressure is related to the quantity of fuel supplied through the nozzle.

10 Claims, 8 Drawing Figures

FUEL SYSTEM FOR COMPRESSION IGNITION ENGINE

This invention relates to a fuel system for supplying fuel to a compression ignition engine and comprising a plurality of electromagnetically controlled fuel injection nozzles, an accumulator in which in use, fuel is stored under pressure and electrical circuit means for effecting operation of said nozzles in timed relationship with the associated engine.

Systems of the aforesaid type are known in the petrol injection art in which the nozzles are opened for a predetermined time. The quantity of fuel which flows through the nozzles whilst they are open depends on a number of factors, one of which is the pressure of fuel in the accumulator. Such systems do not have any means of providing an indication of the amount of fuel supplied to the engine. Reliance is placed on the known parameters of the system so that the quantity of fuel which flows through a nozzle is related to the duration of opening of the nozzle. For a compression ignition engine the pressure in the accumulator is substantially higher than in most petrol injection systems so that slight variations in the operating parameters of the system can result in differences in the quantity of fuel supplied by each injection nozzle. In a compression ignition engine the control of the amount of fuel supplied to the engine is much more critical and it is essential that the quantity of fuel should not in normal running, exceed a predetermined quantity so as to avoid infringement of exhaust emission regulations. It is necessary therefore to have some form of check on the volume of fuel which is being delivered to the engine.

It is known in fuel systems for compression ignition engines to provide a shuttle in a cylinder one end of which during delivery of fuel communicates with the nozzle whilst the other end communicates with the accumulator. Displacement of the shuttle occurs during delivery and the shuttle displacement can be measured to provide an indication of fuel quantity. Valves are required to permit the shuttle to return to the one end of the cylinder either during or before the next delivery of fuel. Such valves are complex and difficult to operate.

The object of the present invention is to provide a fuel system for supplying fuel to a compression ignition engine in a simple and convenient form.

According to the invention in fuel system of the kind specified transducer means is provided to provide a signal representative of the fuel pressure in the accumulator, the signal provided by said transducer means being supplied to the electrical circuit means, said signal providing an indication of the fall in pressure of the fuel within the accumulator a result of fuel flow through the nozzle, said fall in pressure being related to the quantity of fuel supplied through the nozzle and means for delaying the recharging of the accumulator with fuel under pressure.

Examples of fuel systems in accordance with the invention will now be described with reference to the accompanying drawings in which.

Figure 1:
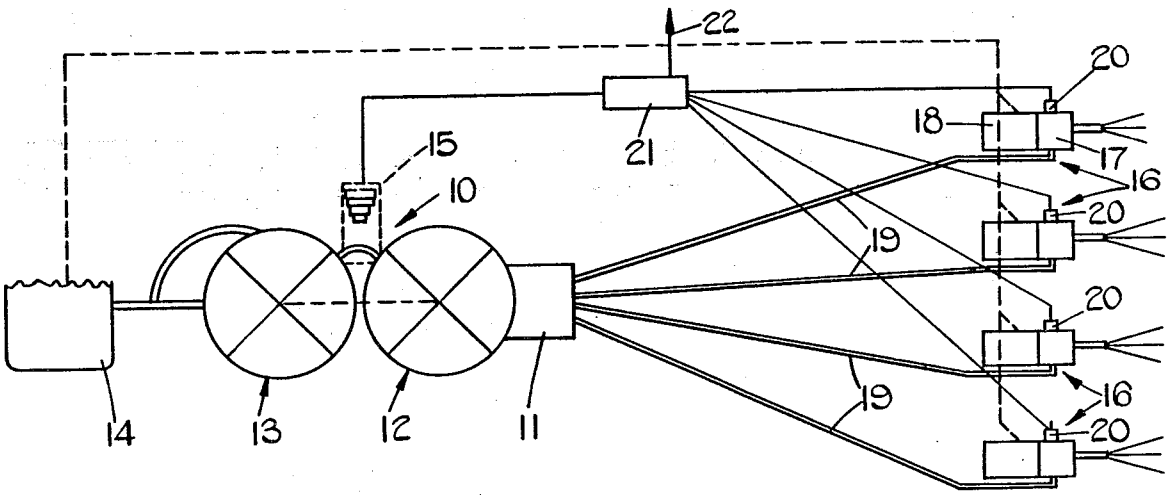
FIGS. 1–4 are diagrammatic representations of different examples of system.

Referring to FIG. 1 of the drawings the fuel injection system comprises a two stage pump generally indicated at 10 and which supplies fuel under pressure to a pump accumulator 11. The pump comprises a high pressure pump 12 having its outlet connected to the accumulator 11 and having its inlet connected to the outlet of a low pressure pump 13 which draws fuel from a supply tank 14. An electromagnetically controlled valve 15 is utilised to control the flow of fuel between the low pressure and high pressure pumps so as to be able to control the pressure within the accumulator 11.

The system includes a plurality of injection nozzles which are indicated at 16. The injection nozzles supply fuel to the combustion spaces of the associated engine. The injection nozzles 16 are of the type shown in FIG. 6 and incorporate a high pressure accumulator 17 and an electromagnetic control 18 which when supplied with electric current opens the valve member of the nozzle to permit fuel to flow from the accumulator 17 through the outlet orifices.

Figure 7:
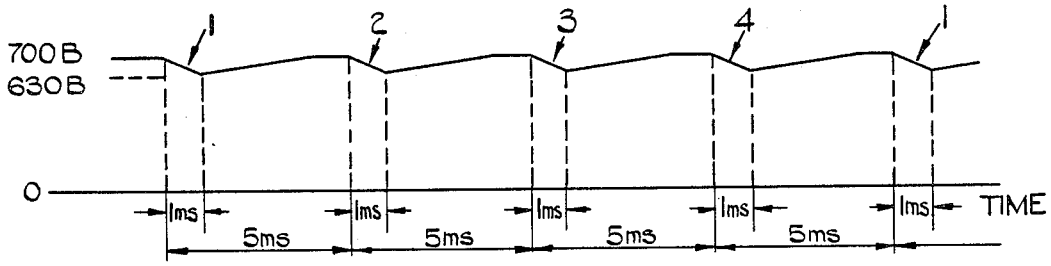
FIG. 7 is a graph showing a time and pressure relationship.

The accumulators 17 of the injection nozzle 16, are connected to the pump accumulator 11 by means of small bore pipes indicated at 19. Moreover, associated with each accumulator 17 is a high pressure transducer 20. The outputs of the transducers 20 are supplied to a control circuit 21 which in turn controls the operation of the valve 15. The circuit 21 also provides an output signal at an output indicated by the reference numeral 22 and this output for an ideal system, is shown in FIG. 7. In this Figure the injectors 16 are numbered 1, 2, 3 and 4. The period between the start of delivery of fuel by the injectors is 5 milliseconds and the period of injection 1 millisecond. This represents an engine speed of 6,000 revolutions per minute and in the particular example the volume of fuel delivered is 50 $mm^3$. The accumulator pressure is shown to fall from 700 Bars to 630 Bars during the period of injection. Following the termination of delivery of fuel the accumulator pressure rises so that it reaches 700 Bars before the next delivery of fuel. It will be appreciated of course that the signal at the output 22 is representative of the pressures in the four accumulators 17. The pressure in one of the accumumulators 17 does not of course vary significantly during the sequence of operation of the remaining three injectors. The fact that the individual accumulator pressures can vary in this manner is largely due to the fact that the pipes 19 connecting the accumulators 17 to the pump accumulator 11 are of a small bore, so that they constitute restriction to the flow of fuel from the pump accumulator and therefore delay the recharging of the individual accumulators. This serves therefore as a reservoir to top up the individual accumulators following the delivery of fuel but as fuel is flowing from the system, the valve 15 will need to be operated to maintain the pressure in the accumulator 11.

Figure 2:
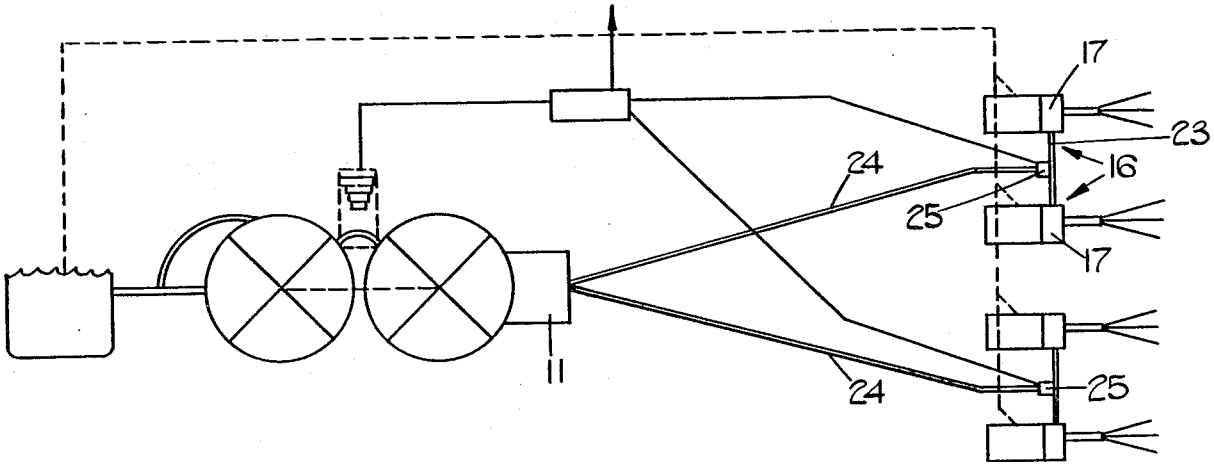

An alternative arrangement is shown in FIG. 2 in which the nozzles 16 are disposed in pairs and the accumulators 17 of a pair of nozzles are connected by a pipe 23 having a size such that there is substantially no restriction to the flow of fuel between the connected accumulators. The pipes 23 are connected to the pump accumulator 11 by means of a small bore pipes 24 and in this example, only two transducers 25 are provided which provide indications of the pressures in the pairs of accumulators of the injection nozzles. This system therefore economises in the number of transducers and also in the number of pipes connecting the accumulators 17 with the accumulator 11.

Figure 3:
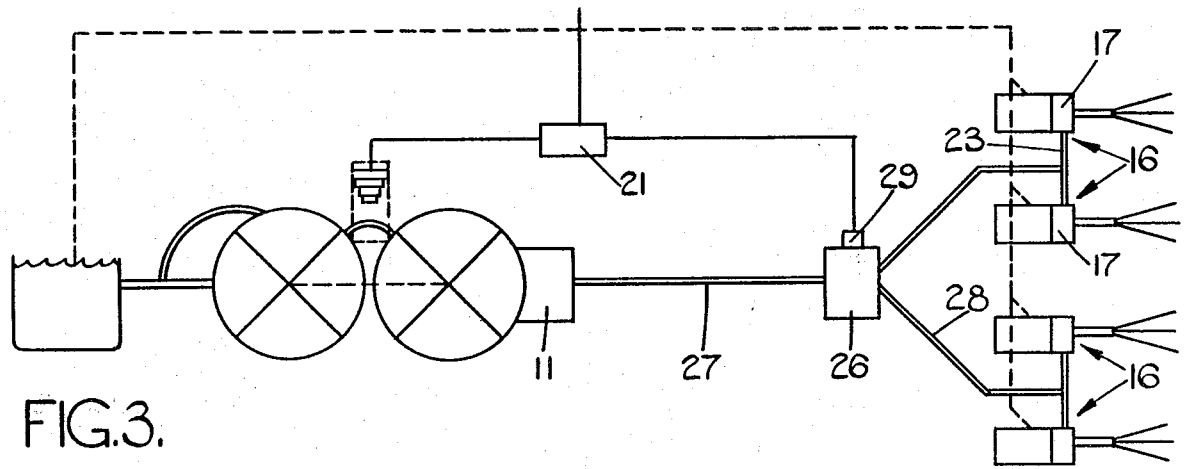

A further reduction in the number of transducers and the number of pipes is effected by adopting the arrangement shown in FIG. 3. In this system the pump accumulator 11 is connected to an intermediate accumulator 26 by means of a single small bore pipe 27. Pairs of the nozzles 16 are connected together as in the example of FIG. 2, by means of large bore pipes 23 and these in turn are connected to the intermediate accumulator 26 again by small bore pipes 28. A single transducer 29 responsive to the pressure within the intermediate accumulator 26 provides a signal to the control circuit 21.

Figure 4:
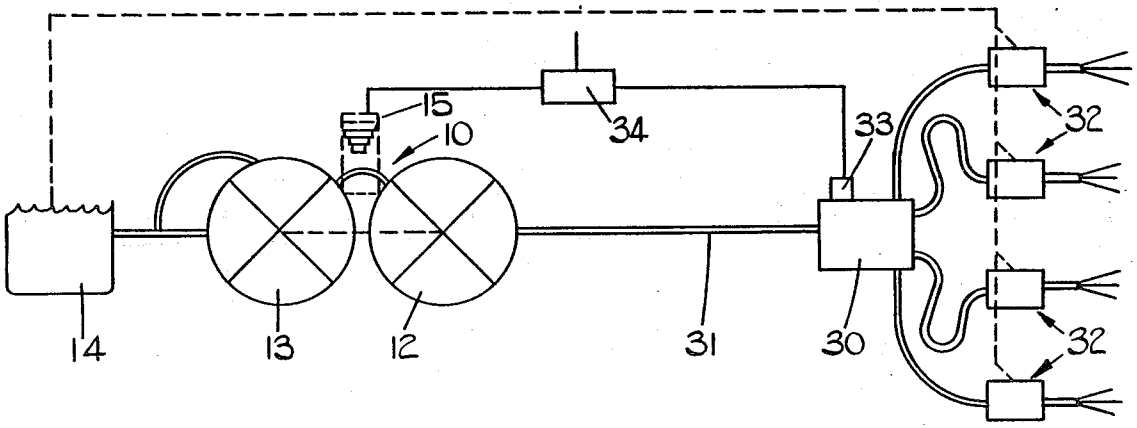

An alternative arrangement is shown in FIG. 4. In this arrangement, the pump 10 supplies fuel at high pressure to an accumulator 30 by way of a small bore pipe 31. The accumulator 30 is connected by way of large bore pipes, to fuel injection nozzles 32 associated with the combustion chambers of the engine respectively. These nozzles may be of the type shown in FIG. 5 or they may be of the type shown in FIG. 6 but without the in-built accumulator. A transducer 33 provides a signal indicative of the pressure within the accumulator 30 and the output signal from the transducer is supplied to an electronic control circuit 34 which performs the same duty as the circuit 21.

It will be appreciated that in each of the systems shown in FIGS. 1–4 the opening and closing of the valves within the fuel injection nozzles must be closely controlled and in timed relationship with the associated engine. For this purpose an electrical control circuit is employed which receives engine position signals so that the valves of the injectors are opened at the appropriate times. In addition the circuit receives the signal indicative of the accumulator pressure which signal provides an indication of the amount of fuel supplied through the injection nozzles. The circuit will also receive a demanded fuel signal and an engine speed signal. In addition it will incorporate means for ensuring that no more than a specified maximum volume of fuel is supplied to the engine depending on various engine operating parameters.

Figure 5:
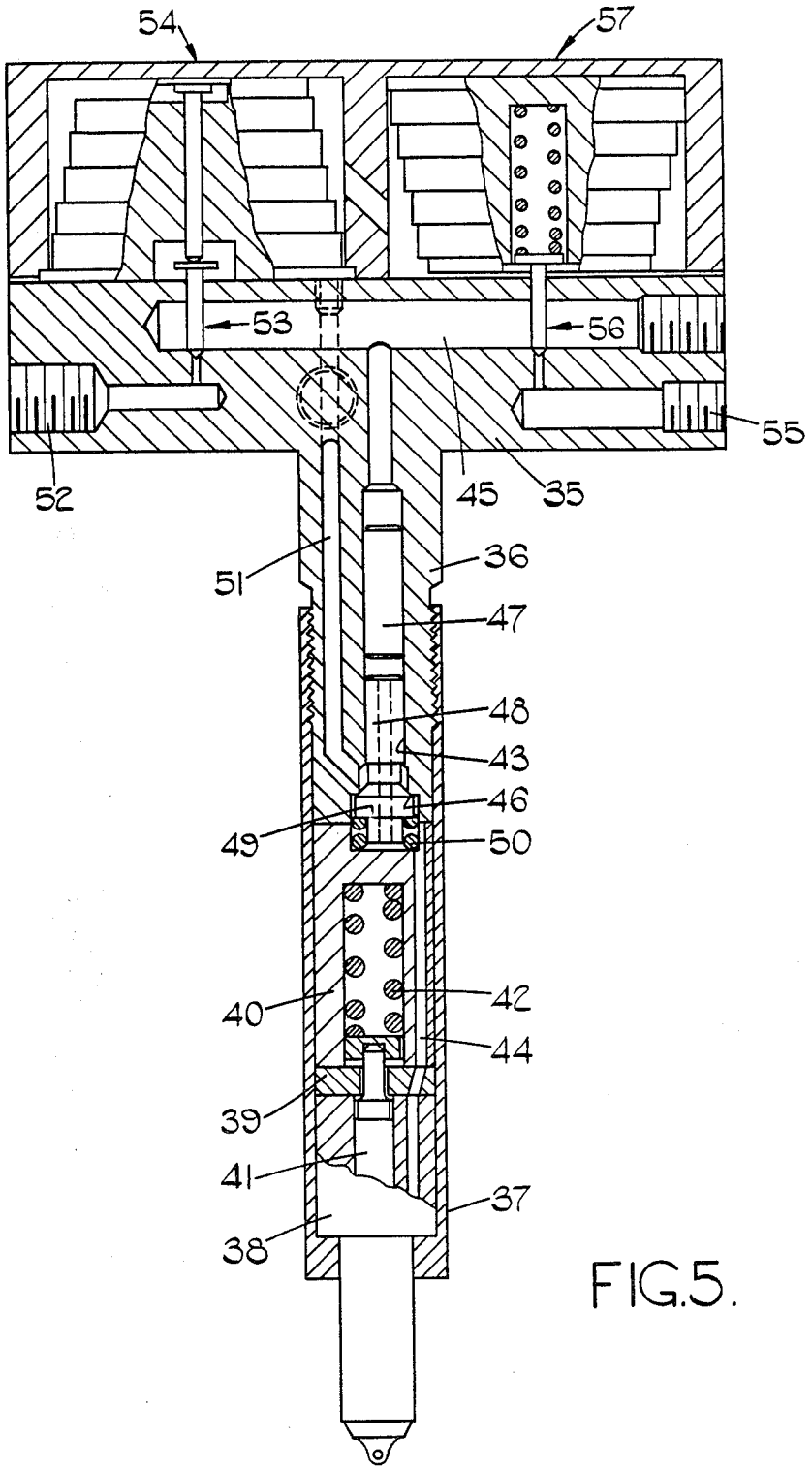
FIG. 5 is a sectional side elevation of one example of a fuel injection nozzle.

Turning now to FIG. 5 of the accompanying drawings, this shows a nozzle of the type indicated at 32 in FIG. 4. The nozzle comprises a body part 35 having a substantially cylindrical extension 36 which is screw threaded on its external peripheral surface to receive an elongated cap nut 37. The cap nut 37 retains in assembly, a nozzle head 38, a distance piece 39 and a cylindrical member 40. The nozzle head 38 is provided with the conventional form of valve member 41 which is spring loaded to the closed position by means of a coiled compression spring 42 which is accommodated within a chamber defined in the member 40. The distance member 39 acts to minimise the extent of movement of the valve member 41 against the action of the spring 42. Moreover, formed in the extension 36 is a bore 43 which has a continuation within the member 40. This end of the bore is connected by means of a passage 44 located in the member 40 and extending to the nozzle unit 38 and through which in use, high pressure fuel flows to the nozzle head. The bore 43 at its end adjacent the body 35, communicates with a cross drilling 45 formed in the body part 35 and at its other end, it defines a seating 46 which is of slightly larger diameter than the bore. Located within the bore 43 is a free piston 47 and a valve member 48 which has a cylindrical portion integral with a head 49 which is shaped for cooperation with the seating 46. The head is biassed into contact with the seating by means of a spring 50. Moreover, the valve member 48 has a passage extending therethrough and defined between the bore and the valve member is an annular space which communicates with a passsage 51 extending to the body part 35 and which in use, is connected to a source of fuel at low pressure conveniently the first stage 13 of the pump 10.

In the body part 35 is formed an inlet 52 which is connected in the example shown in FIG. 4, to the fuel accumulator 30. Flow of fuel between the inlet 52 and the drilling 45 is controlled by a valve 53 which includes an electromagnetic valve operator 54. Moreover, an outlet 55 is provided and this can be connected to the drilling 45 by way of a valve 56 having an operator 57. In use, when fuel is required to be delivered to the engine, the valve 53 is opened to permit fuel at accumulator pressure to act against the upper end of the free piston 47. The force exerted by the fuel under pressure acting on the free piston moves the piston downwardly to pressurise the fuel contained in the passage in the valve member and the passage 44. The valve member 41 of the nozzle is lifted by this fuel pressure and fuel is delivered to the engine. Termination of fuel flow is achieved when the free piston physically engages the valve member 48. When this occurs the valve head 49 is lifted from the seating and the passage 44 is placed in communication with the low pressure pump. Hence the valve member 41 closes quickly. The valve 53 is then closed and the valve 56 opened. When the valve 56 is opened fuel under pressure from the low pressure pump maintains the valve head 49 away from the seating and fuel flows into the bore 43 by way of the passage in the valve member thereby displacing the free piston 47 upwardly. This fuel is of course derived from the low pressure pump however, an indication of the amount of fuel which has been delivered by the injection nozzle has been obtained from the transducer 33 and this signal is used to determine the time during which the valve 56 is maintained in the open position. When the valve 56 is closed, the pressure of fuel acting on the ends of the valve member 49 is balanced and the valve member moves to the closed position under the action of the spring 50. The parts of the injection nozzle then remain in this position until delivery of fuel is required again whereafter the process is repeated. Thus in this example the signal obtained from the transducer during delivery of fuel, is used to determine the time during which the valve 56 is maintained in the open position.

Figure 6:
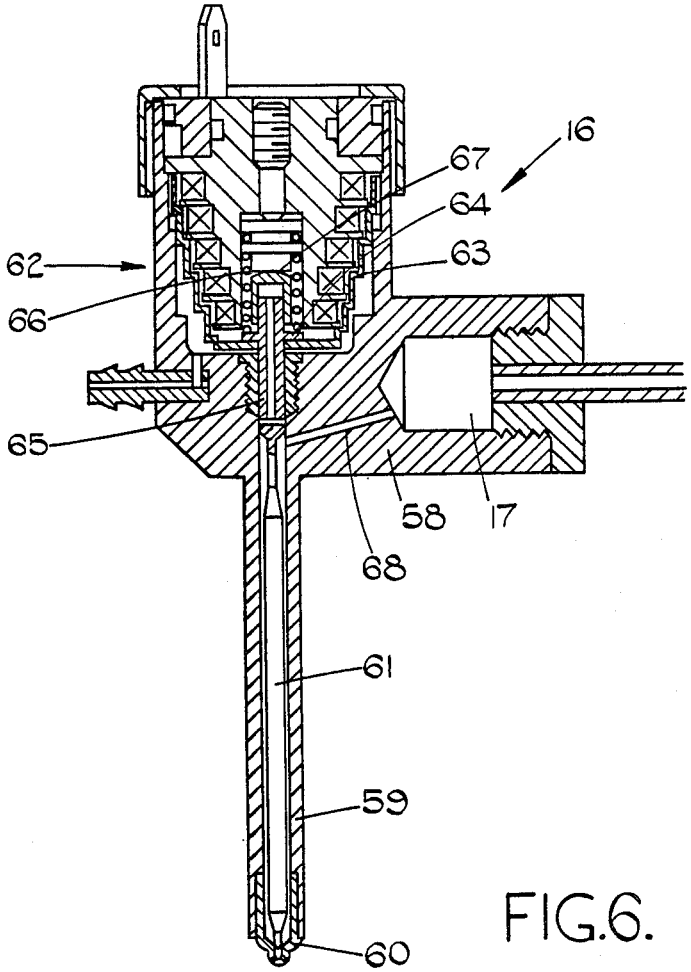
FIG. 6 is a view similar to FIG. 5 showing an alternative example.

Turning now to FIG. 6, this shows an injection nozzle 16 of the type utilised in the systems of FIGS. 1–3 inclusive. The injection nozzle comprises a body 58 having a cylindrical extension 59 at the end of which is secured a nozzle head 60. Located with clearance within the extension is an axially movable valve member 61 which at its end adjacent the nozzle head, is shaped to co-operate with a seating thereby to control the flow of fuel through spray orifices formed in the extremity of the nozzle head. The valve member is movable away from the seating by the action of an electromagnetic device generally indicated at 62 and which includes a cup-shaped armature 63 which is engageable with a flange 64 formed on a cylindrical part 65 which engages the valve member. A spring 66 is provided to bias the part against the valve member and also the valve member into contact with the aforesaid seating. The part 65 has a passage extending therethrough and it extends into a cup-shaped member 67 which is held against axial movement. The bore accommodating the valve member communicates with the accumulator 17 by way of a drilling 68 and in use, when the electromagnetic device is supplied with electric current, the armature 63 moves upwardly to move the part 65 against the action of the spring 66 thereby to permit the valve member 61 to move upwardly and allow flow of fuel from the accumulator 17 through the outlet orifices. When electric current ceases to flow the part 65 moves downwardly under the action of the spring to close the valve member 61 onto its seating. The nozzle seen in FIG. 6 may be modified by removing the accumulator 17 and connecting the passage 68 directly to the accumulator 30 seen in FIG. 4.

In this example, the transducer which provides an indication of the pressure within the accumulator, provides a signal which falls as delivery of fuel is taking place. After a predetermined fall in pressure, the valve member of the nozzle is closed.

Where nozzles of the type shown in FIG. 6 are utilised there is a substantial risk that if the valve member should become jammed in the open position, fuel will be fed continuously to the associated combustion space. Means is therefore provided in the control circuit 21 to sense when the pressure in the accumulator 17 has dropped more than a predetermined value. If this fault arises then the engine is stopped. A similar problem can occur if for example the tip of the injection nozzle becomes detached from the body. A very rapid reduction in the pressure of fuel within the accumulator will take place when the valve member is opened and again this pressure drop is sensed to prevent further supply of fuel to the engine.

During operation of the system it could occur that one nozzle becomes partially blocked so that if the nozzle is opened for the same time as the remaining nozzles, less than the required volume of fuel will be supplied to the respective combustion space. This fault will however reveal itself to the control system which will note less of a reduction in the pressure in the accumulator at the end of the delivery of fuel by that nozzle. Correction can be obtained by lengthening, for that particular nozzle, the time during which the valve member is open. Thus the nozzles may each have a different opening period in order to meet the requirement that each fuel injection nozzle should deliver the same amount of fuel.

Figure 8:
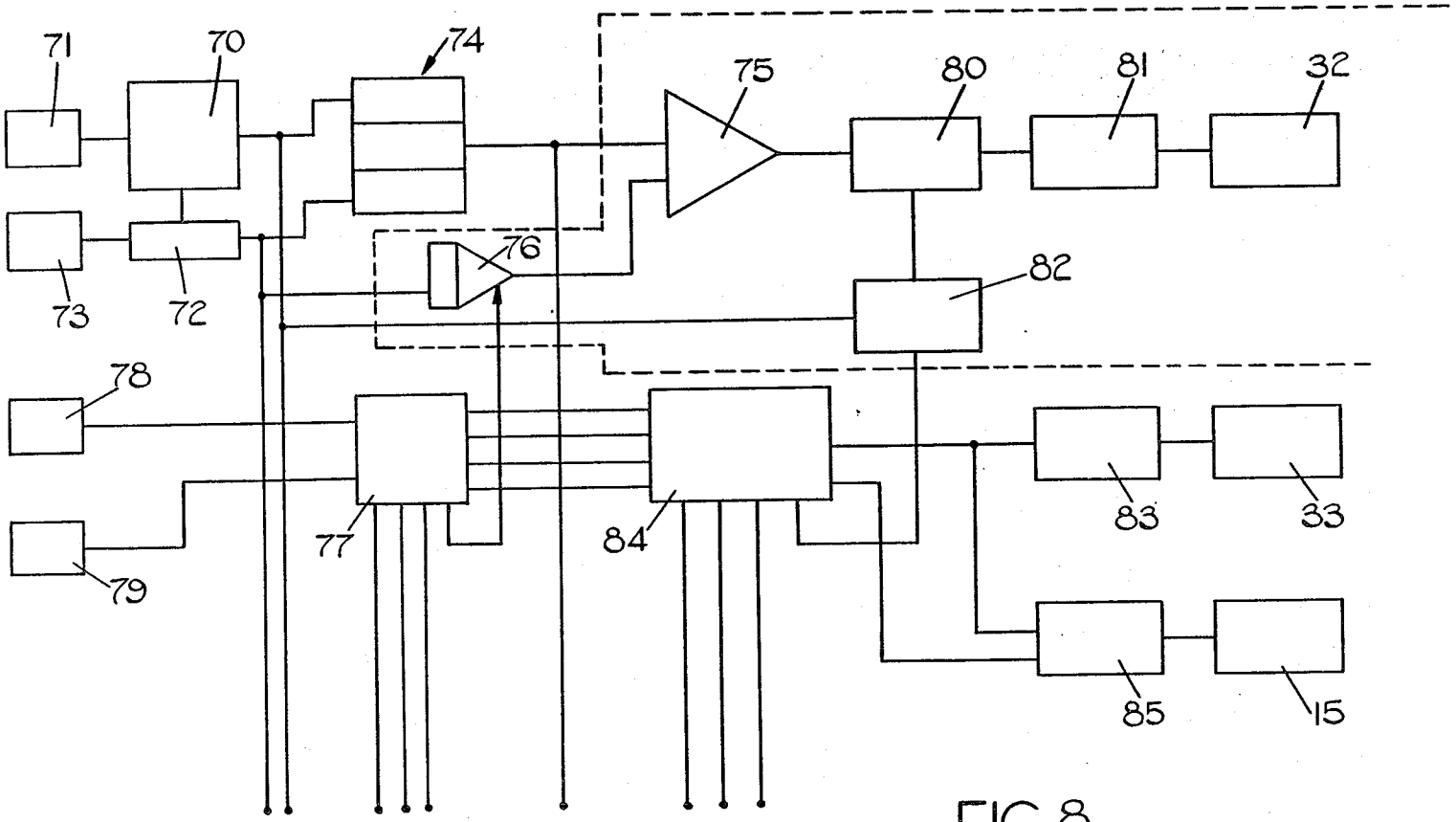
FIG. 8 shows in block form one example of a control system.

Reference is now made to FIG. 8 in which is shown a control system for use with the fuel system which is shown in FIG. 4, that is to say the system which has an accumulator 30 and an associated pressure transducer 33, the accumulator being connected to the outlet of the high pressure pump 12 of the two stage pump 10. FIG. 8 in fact shows, in greater detail, the control circuit 34.

With reference to FIG. 8 there is provided a governor circuit 70 the output signal from which is a required fuel signal. In order for the governor circuit to determine this signal it is provided with a demanded fuel signal from a transducer 71 which is associated with the throttle pedal of the vehicle, and a speed signal from a decoding circuit 72 which is supplied with a signal from a transducer 73 which is associated with a rotary part of the engine.

The required fuel signal and also a speed signal from the decoder, are supplied to a circuit 74 which determines the desired timing of delivery of fuel to the associated engine. The circuit 74 is shown to be divided into three parts, one of which is responsible for determining the timing as the required quantity of fuel is varied, the second part being responsible for providing variation of the timing of delivery of fuel in accordance with the engine speed, and the third being a reference which provides for the static timing of the delivery of fuel. The output signal from the circuit 74 is applied to a comparator 75.

A further input to the comparator 75 is provided by an integrating circuit 76 which receives the engine speed signal from the decoder 72 and it also receives a signal from an engine position determining circuit 77, the circuit 77 is provided with signals by a pair of transducers 78, 79, the transducer 78 providing signals at each revolution of the engine, equal to half the number of engine cylinders and the transducer 79 providing a signal twice per revolution of the engine. In the particular case the system is for providing fuel to a four cylinder engine. The circuit 77 has four outputs, one for each engine cylinder and the signal provided by the integrator to the comparator 75 is such that the signal from the output of the comparator appears at the time required for delivery of fuel. This takes into account the variation in timing required for different engine speeds and loads. The output of the comparator 75 is supplied to a pulse circuit 80 which through an amplifier 81 is applied to the winding of the injector 32. The winding remains energised until a stop signal is applied to the pulse circuit 80. This signal is supplied by an adder 82 which receives the desired fuel signal from the output of the governor 70 and a further signal which is indicative of the amount of fuel supplied through the particular injector to the associated engine. When the required amount of fuel has been supplied, the stop signal is applied to the pulse circuit and the solenoid contained in the injector is de-energised. The sequence described above does of course need to take into account the delay which occurs between energisation of the solenoid in the injector and the commencement of flow of fuel and similarly the delay between de-energising the solenoid and the cessation of flow of fuel.

The accumulator pressure transducer is indicated at 33 and its output is applied to a digital to analogue converter 83, the input of which is supplied to a fuel correction circuit 84. This circuit also receives outputs from the circuit 77 so that it can provide to the adder circuit 82 the information which is appropriate to the injector 32 with which the adder 82 is associated. It will be appreciated that whilst there is only one transducer 33 in the system shown in FIG. 4, its signals control four injection nozzles and the portion of the circuit diagram which is individual to each injection nozzle lies within the dotted line in FIG. 8. The circuit 84 has three outputs for connection to the adders 82 of the remaining injectors. In the system shown in FIG. 4 the transducer 33 may immediately register the pressure drop which takes place when a particular injection nozzle is opened. There may however be a delay in the registration of the pressure drop and the circuit 84 may therefore incorporate a memory to hold the actual fuel quantity signal relevant to a particular injector until the next time the injector is operated. This facility is of course required if the system is of the type which is shown in FIG. 3 since in this case the pressure drop signals which are provided by the transducer 29 occur later than the actual delivery of fuel by a particular injector.

The logic unit also corrects for unequal pressure drops measured at the accumulator, for a complete cycle of operation i.e. when each injector has delivered fuel. One injector may be slow to open or may be partly blocked so that the amount of fuel delivered through that injector in a given period of time is less than for the remaining injectors. The logic unit remembers the maximum pressure drop and adjusts the time of opening of the remaining injectors to ensure that each injector delivers the same amount of fuel. The extent of adjustment of the time is limited to avoid the possibility of a blocked injector delivering fuel over an extended period.

Also shown in FIG. 8 is an accumulator pressure control circuit 85 which receives a signal from the converter 83 to control the operation of the valve 15 interposed between the high and low pressure pumps. A further connection is provided to the control circuit 85 from the circuit 84 which prevents recharging of the accumulator until the discharge of fuel through an injector has ceased. This is to ensure that the measurement of the pressure drop due to delivery of fuel is not upset by the accumulator charging process.

I claim:

1. A fuel system for supplying fuel to a compression ignition engine comprising a plurality of electromagnetically controlled fuel injection nozzles, an accumulator in which in use, fuel is stored under pressure, electrical circuit means for effecting operation of said nozzles in timed relationship with the associated engine, transducer means for providing a signal representative of the fuel pressure in said accumulator, the signal provided by said transducer means being supplied to the electrical circuit means, said signal providing an indication of the fall in pressure of the fuel within said accumulator as a result of fuel flow through the nozzle, said fall in pressure being related to the quantity of fuel supplied through the nozzle and means for delaying the recharging of the accumulator with fuel under pressure.

2. A fuel system according to claim 1 in which each injection nozzle has a accumulator associated therewith, said accumulators being connected to a source of fuel under pressure by way of a small bore pipe, said pipe acting to delay the recharging of the accumulator with fuel under pressure.

3. A fuel system according to claim 2 in which said transducer means comprises transducers responsive to the pressures in said accumulators respectively.

4. A fuel system for supplying fuel to a compression ignition engine comprising a plurality of electromagnetically controlled fuel injection nozzles, an accumulator associated with each injection nozzle in which in use, fuel is stored under pressure, the accumulators of pairs of said nozzles being interconnected by a large bore pipe, said large bore pipes being connected through small bore pipes to a source of fuel under pressure, said small bore pipes acting to delay the recharging of the accumulators with fuel under pressure, electrical circuit means for effecting operation of said nozzles in timed relationship with the associated engine, transducers responsive to the pressures in said large bore pipes for providing signals representative of the fuel pressure in said accumulators, the signals provided by said transducers being supplied to the electrical circuit means, said signals providing an indication of the fall in pressure of the fuel within said accumulators as a result of fuel flow through the nozzles, and said fuel in pressure being related to the quantity of fuel supplied through the nozzles.

5. A fuel system according to claim 4, in which said source of fuel under pressure comprises a low pressure pump, a high pressure pump which receives fuel from said low pressure pump, a pump accumulator which receives fuel at high pressure from said high pressure pump, a valve operable to control fuel flow between the low pressure and high pressure pumps and thereby the pressure in said pump accumulator.

6. A fuel system for supplying fuel to a compression ignition engine comprising a plurality of electromagnetically controlled fuel injection nozzles, an accumulator associated with each injection nozzle in which in use, fuel is stored under pressure, said accumulators being connected to a source of fuel under pressure including a further accumulator by way of a small bore pipe, said pipe acting to delay the recharging of the first said accumulator with fuel under pressure, electrical circuit means for effecting operation of said nozzles in times relationship with the associated engine, a transducer responsive to the pressure in said further accumulator for providing a signal representative of the fuel pressure in said further accumulator, the signal provided by said transducer being supplied to the electrical circuit means, said signal providing an indication of the fall in pressure of the fuel within the first said accumulator as a result of fuel flow through the nozzle, said fall in pressure being related to the quantity of fuel supplied through the nozzle.

7. A fuel system according to claim 6 in which said source of fuel under pressure comprises a low pressure pump, a high pressure pump which receives fuel from said low pressure pump, a pump accumulator which receives fuel at high pressure from said high pressure pump, a valve operable to control fuel flow between the low pressure and high pressure pumps and thereby the pressure in said pump accumulator, and a small bore pipe connecting said pump accumulator with said further accumulator.

8. A fuel system for supplying fuel to a compression ignition engine comprising a plurality of electromagnetically controlled fuel injection nozzles, an accumulator associated with each injection nozzle in which in use, fuel is stored under pressure, said accumulators being connected to a source of fuel under pressure by way of a small bore pipe, said pipe acting to delay the recharging of the accumulator with fuel under pressure, electrical circuit means for effecting operation of said nozzles in timed relationship with the associated engine, transducer means for providing a signal representative of the fuel pressure in said accumulator, the signal provided by said transducer means being supplied to the electrical circuit means, said signal providing an indication of the fall in pressure of the fuel within said accumulator as a result of fuel flow through the nozzle, said fall in pressure being related to the quantity of fuel supplied through the nozzle, and said source of fuel under pressure comprises a low pressure pump, a high pressure pump which receives fuel from said low pressure pump, a pump accumulator which receives fuel at high pressure from said high pressure pump, a valve operable to control fuel flow between the low pressure and high pressure pumps and thereby the pressure in said pump accumulator.

9. A fuel system for supplying fuel to a compression ignition engine comprising a plurality of electromagnetically controlled fuel injection nozzles, an accumulator associated with each injection nozzle in which in use, fuel is stored under pressure, said accumulators being connected to a source of fuel under pressure by way of a small bore pipe, said pipe acting to delay the recharging of the accumulator with fuel under pressure, electrical circuit means for effecting operation of said nozzles in timed relationship with the associated engine, transducers responsive to the pressures in said accumulators respectively for providing signals representative of the fuel pressure in said accumulators, the signals provided by said transducers being supplied to the electrical circuit means, said signals providing an indication of the fall in pressure of the fuel within said accumulators as a result of fuel flow through the nozzles, said fall in pressure being related to the quantity of fuel supplied through the nozzles, and said source of fuel under pressure comprises a low pressure pump, a high pressure pump which receives fuel from said low pressure pump, a pump accumulator which receives fuel at high pressure from said high pressure pump, a valve operable to control fuel flow between the low pressure and high pressure pumps and thereby the pressure in said pump accumulator.

10. A fuel system for supplying fuel to a compression ignition engine comprising a plurality of electro-magnetically controlled fuel injection nozzles, an accumulator in which in use, fuel is stored under pressure, electrical circuit means for effecting operation of said nozzles in timed relationship with the associated engine, transducer means for providing a signal representative of the fuel pressure in said accumulator, the signal provided by said transducer means being supplied to the electrical circuit means, said signal providing an indication of the fall in pressure of the fuel within said accumulator as a result of fuel flow through the nozzle, said fall in pressure being related to the quantity of fuel supplied through the nozzle and means for delaying the recharging of the accumulator with fuel under pressure, said source of fuel under pressure comprising a low pressure pump, a high pressure pump which receives fuel from said low pressure pump, a valve operable to control fuel flow between the low pressure and high pressure pumps, a small bore pipe connecting the outlet of the high pressure pump with said accumulator, and large bore pipes connecting said accumulator to the injection nozzles respectively.

* * * * *